US006132915A

United States Patent [19]

Yoshino et al.

[11] Patent Number: 6,132,915

[45] Date of Patent: Oct. 17, 2000

[54] IMAGE-FORMING PROCESS

[75] Inventors: Susumu Yoshino; Yasuhiro Oya; Masanobu Ninomiya; Hirokazu Hamano; Koutarou Yoshihara; Kaori Oishi; Tetsuya Taguchi; Haruhide Ishida, all of Minamiashigara, Japan

[73] Assignee: Fuji Xerox Co., Ltd., Tokyo, Japan

[21] Appl. No.: 09/451,515

[22] Filed: Nov. 30, 1999

[30] Foreign Application Priority Data

Feb. 10, 1999 [JP] Japan ..... 11-033178

[51] Int. Cl.[7] ..... G03G 13/08

[52] U.S. Cl. ..... 430/102; 430/120

[58] Field of Search ..... 430/102, 120

[56] References Cited

U.S. PATENT DOCUMENTS 5,604,074 2/1997 Yasuda et al. ..... 430/102
5,966,570 10/1999 Till et al. ..... 430/120

FOREIGN PATENT DOCUMENTS

H5-19632 1/1993 Japan .
H58-15979 1/1996 Japan .

*Primary Examiner*—Roland Martin
*Attorney, Agent, or Firm*—Oliff & Berridge, PLC

[57] ABSTRACT

Provided is an image-forming process including a step of forming an electrostatic latent image on a latent image-carrier and a step of developing the latent image by a developer on a developer-carrier disposed facing the electrostatic latent image-carrier, a developer contains a color toner containing a wax which amount is from 1 to 10% by weight of the toner is used, and the developer-carrier wherein a ten-point average roughness (Rz) of the surface thereof of and the average spacing (Sm) of roughness peaks meet the following formula is used; $5 \leqq Rz \times 20 \leqq Sm$. By the process, the conveying property of the developer is good, staining of the surface of the developer-carrier can be prevented, and images having a high quality and excellent in the fixing property over a long period time is obtained even in the case of using oil-less color toners containing a wax.

17 Claims, No Drawings

IMAGE-FORMING PROCESS

BACKGROUND OF THE INVENTION

1. Field of the Invention

The present invention relates to an image-forming process utilizing an electrophotographic method or an electrostatic recording method, and more specifically to an image-forming process developing an electrostatic latent image on an electrostatic latent image-carrier using a developer carried on a developer-carrier.

2. Description of the Related Art

A toner used for an electrophotographic process is generally produced by adding a coloring agent, a charge controlling agent, and releasing agent to a resin such as a polyester resin, a styrene-acrylic resin, an epoxy resin, etc., followed by melt-kneading the mixture, and after uniformly dispersing, by a grinding/classifying method of grinding the dispersion to definite particle sizes and further removing excessive course particles and fine particles using a classifier, but with the recent requirement of far increasing the image quality, it becomes necessary to further fining the particle sizes of a toner. Also, from the requirement of energy saving, a toner having a lower glass transition point and a lower softening point than the resin capable of fixing at a lower temperature has been used.

In color toners used for a full color copying machine or printer, it is necessary that the many color toners are sufficiently mixed in a fixing step, and also the color reproducibility and the transparency of an OHP image are important. To increase the color mixing property, color toners are generally formed with low-molecular weight resins having a sharp melting property as compared with a black toner. Consequently, there is a problem that an offset is liable to occur.

Hitherto, in a black toner, for obtaining an offset resistance at fixing, a wax having a high crystallizability and a relatively high melting point, such as polyethylene, polypropylene, etc., is used but in color toners for full color, the toners do not contain a wax for the reason of reducing the transparency of an OHP image, and a method of forming the surface of heat-fixing roller with a silicone rubber or a fluorine resin excellent in the releasing property to the toners, and further supplying a releasing liquid such as a silicone oil, etc., to the surface of the roller is employed for preventing the occurrence of offset.

The above method is very effective in the point of preventing the occurrence of the offset phenomenon of toners but there is a problem that an apparatus for supplying an offset prevention liquid become necessary. This is against the direction of small-sizing and light-weighing recently required, and also that is a problem that the offset preventing liquid is evaporated by heating to generate an unpleasant odor and contaminate the inside of the machine.

Accordingly, about color toners, particularly, color toners for full color, toners containing a low-melting wax have been investigated for realizing an oil-less system without reducing the characteristics required to color toners, such as a low-temperature fixing property, a sharp melting property, the reduction of the particle sizes of color toners, etc.

However, in color toners containing a wax, there are problems that the conveying property thereof is inferior, they cause staining a developer-carrier, and they cause image defects such as the density unevenness of images, etc. For example, in a method of carrying a two-component system developer having a toner and a carrier, developing an electrostatic latent image, and after transferring the toner image formed onto a transfer material, fixing the toner image to the transfer material, it is usually necessary that a proper and uniform developer layer is formed on the developer-carrier by a regulating member facing the developer-carrier. When a repeating imaging test is carried out using the two-component developer having the toner as described above by a developing machine having such a developer regulating member, the toner attaches the surface of the developer-carrier to stain the surface. By progressing the stain, the amount of the developer on the developer-carrier is changed to change the amount of the developing toner, whereby the density of the image formed is changed, a density unevenness in a solid image occurs, and the quality of the printed image is deteriorated.

The reason that the toner is liable to attach the surface of a developer-carrier has not yet been clarified but it is supposed that because the color toner containing a wax is more liable to be deformed than a conventional black toner and a color toner without containing wax and because the color toner contains many toners having small particle sizes and by the toners of the small particle sizes, the attaching property is relatively increased, the toner attaches to the surface of the developer-carrier as being rubbed thereto by a mechanical load to stain the surface. Also, it is considered to be a cause that the toner has a wax-exposed portions on the surface thereof.

In Japanese Patent Laid-Open No. H5-19632, for solving such a problem of staining the surface of the developer-carrier by the toner, a method of polishing the surface of the developer-carrier with large spherical particles such that the surface roughness Rz becomes a definite range is proposed. However, the method is not a system designed on the assumption of the developer using the toner made of a sharp melting resin and containing a low-melting wax and in the method, although in a repeating imaging durability test, there is a stain-preventing effect in the beginning, in the case of carrying out repeated imaging, staining cannot be sufficiently prevented.

In Japanese patent Laid-Open No. H8-15979, an image-forming method wherein the centerline average roughness (Ra) of the surface of the developer-carrier and the average spacing (Sm) of roughness peaks are define for improving the conveying property of a spherical toner is proposed. However, the spherical toner has a high fluidity and for conveying the toner, it is necessary to form large unevenness to some extent on the surface of the developer-carrier and thus in the case of using a random-shaped toner produced by a grinding/classifying method, the unevenness of the surface of the developer-carrier to too large to prevent sufficiently staining.

As described above, because the oil-less toners containing a wax are inferior in the conveying property and cause staining the developer-carrier, an image-forming process capable of using these toners in a practically using level has not yet been obtained.

SUMMARY OF THE INVENTION

This invention provides an image-forming process having a good conveying property of a developer, capable of preventing staining of the surface of the developer-carrier, and capable of obtaining images of a high image quality and excellent in the fixing property in the case of using oil-less color toners containing a wax.

As a result of various investigations on mainly a developer-carrier from a different view points from related art for solving the above-described problems in the techniques of related art, the present inventors have found that the above-described advantages can be attained by the present invention as described hereinbelow.

That is, in the image-forming process of this invention, it is a presupposition to use an oil-less color toner without supplying a releasing agent or supplying a slight amount of a releasing agent by containing therein a wax, and according to this invention, there is provided an image-forming process having a step of forming an electrostatic latent image on an electrostatic latent image-carrier and a step of developing the electrostatic latent image by a developer on a developer-carrier disposed facing the electrostatic latent image-carrier, wherein the developer contains a color toner containing a wax which amount is from 1 to 10% by weight of the toner, and ten-point average roughness (Rz) and average spacing (Sm) of roughness peaks of the surface of the developer-carrier meet the following formula;

$$5 \leqq Rz \times 20 \leqq Sm.$$

According to the image-forming process, because when the developer carried on the developer-carrier is conveyed to a developing region, the developer can be uniformly and stably conveyed over a long period of time, and also staining of the surface of the developer-carrier with the toner components can be restrained, there occurs no problem on the developing property in the developing region over a long period of time, and images of a high quality without having uneven image density can be stably obtained.

Furthermore, in the developer-carrier, it is preferred that Rz of the surface thereof is in the range of the following formula;

$$0.5 \leqq Rz \leqq 10.$$

In a development system used for developing an electrostatic latent image, there are a one-component development system of using a toner only and a two-component system of using a toner and a carrier. In the two-component developer of the two-component development system, by stirring the toner and the carrier of the developer, toner is frictional-charged and thus by selecting the characteristics of the toner and the stirring condition, the frictional charging amount of the toner can be controlled to a considerable extent and in the system, the reliability of the image quality is more excellent. In this invention, in the point of the reliability of the image quality, it is preferred that the developer is the two-component developer composed of a toner and a carrier.

At present, employing smaller particles of toner has been demanded to increase the image quality and in the particle size distribution of the toner, it is known that smaller particle size toner give particularly influences on the image quality. Consequently, in this invention, it is preferred that in the toner, the amount of particles having a particle sizes of 4 $\mu$m or less in the particle size distribution is from 10 to 30% by number.

Also, to improve the color reproducibility and the transparency of an OHP image, it is preferred that the viscosity of the toner is $10^6$ poises or less at 120° C. and also it is preferred that the melting point of the wax is from 80 to 120° C. In addition, the viscosity of the toner is measured by a heat-curing type flow tester.

DETAILED DESCRIPTION OF THE INVENTION

Then, the image-forming process of this invention is explained in detail.

The image-forming process of this invention is an image-forming process having a step of forming an electrostatic latent image on an electrostatic latent image-carrier and a step of developing the electrostatic latent image by a developer on a developer-carrier disposed opposite to the electrostatic latent image-carrier, in which it is a large feature that ten-point average roughness (Rz) of the surface of the developer-carrier and average spacing (Sm) of roughness peaks meet the following formula;

$$5 \leqq Rz \times 20 \leqq Sm.$$

That is, it is necessary that $0.25 \leqq Rz$ and also $20 \leqq Sm/Rz$.

Rz and Sm are the ten-point average roughness and the average spacing of roughness peaks based on the JIS-B0601 ('94) standard respectively. The measurements of Rz and Sm in this invention are carried out by placing a developer-carrier on a connected automatic rotary table and while rotating, the Rz and Sm of the circumference direction are measured by a surface roughness meter (Surfcom 1400 A, trade name, manufactured by Tokyo Seimitsu K.K.) based on the JIS standard.

If Rz is less than 0.25, the conveying property of the developer is disturbed and the density unevenness of copied image is liable to occur. Thus, Rz is preferably in the range of $0.5 \leqq Rz \leqq 10$, and is more preferably in the range of $1 \leqq Rz \leqq 8$.

Sm shows the average spacing of roughness peaks, that is, the roughness of of the surface of the developer-carrier, and as Sm is larger, the surface is smoother. In this invention, it is important to restrain the value of Rz by the relation with Sm and it is necessary that $20 \leqq Sm/Rz$. When Sm is smaller than 20 times the value of Rz, the inclination of the unevenness becomes large even when the value of Rz is same and the roughness of the surface becomes substantially large. As the result thereof, the toner containing a wax, particularly, toner having small sizes attach to the concaved portions, and at conveying the developer or by the mechanical load receiving at the region of regulating the conveying amount of the developer by a regulating member facing the developer-carrier and the heat locally generated thereby, the attached toner is welded to the surface of the developer-carrier.

Also, it is more preferred that $Sm/Rz \leqq 100$. When Sm becomes larger than 100 times the value of Rz, because the developer becomes liable to be held by the developer-carrier owing to the weak holding force of the developer to the developer-carrier, the conveying amount of the developer becomes unstable and as the result thereof, the image density unevenness is liable to occur.

Sm of the surface of a developer-carrier which has hitherto been used is from 60 to 80 but as a suitable range of Sm for a random-shape toner having a large particle size distribution and containing many toners having small particle sizes, the lower limit of Sm is preferably 80 or more, more preferably 100 or more, and far more preferably 110 or more. Also, to ensure the holding force of the developer to the developer-carrier, the upper limit of Sm is preferably 200 or less.

As a method of producing the developer-carried having the definite surface roughness in this invention, for example, a sand blast method using random-shape particles or definite shape particles as grinding particles, a sand paper method rubbing the sleeve surface with a sand paper having formed thereon unevenness in the sleeve circumference direction, a method by a chemical treatment, and a method of forming convex portions of a resin after coating the resin can be used.

In the case of this invention, it is preferred that there are no sharp convex portions on the blasted surface of the developer-carrier, and by using the developer-carrier of the surface state, welding of the toner and straining with the toner can be remarkably restrained. To obtain the roughness of such a surface state, a sand blast method using spherical particles such as glass beads, etc., as the grinding particles is preferred.

As the material of the developer-carrier in this invention, known materials can be used. For example, the materials include metals such as aluminum, stainless steel, nickel, etc.; these metals coated with carbon, a resin elastomer, etc.; non-foamed materials, foamed materials, or spongy materials formed from elastic materials such as a natural rubber, a silicone rubber, a urethane rubber, a butadiene rubber, a chloroprene rubber, etc., and these materials coated thereon carbon, a resin elastomer, etc.

The form of the developer-carrier in this invention may be a cylindrical form or a sheet form.

When the developer-carrier is a developing sleeve, the diameter of the developing sleeve is preferably from 10 mm to 35 mm, and more preferably from 15 mm to 27 mm from the points of the development efficiency and restraining the occurrence of welding of the toner. Also, in the case of a two-component developer composed of a non-magnetic toner and a magnetic carrier, a magnetic field generator such as a magnet is contained in the inside of the developer-carrier.

Developer:

In the image-forming process of this invention, it is the presupposition to use a developer using color toner(s) containing a wax which amount is from 1 to 10% by weight of the toner as the developer. The developer in this invention may be a one-component developer using the toner only or a two-component developer using the toner and a carrier but from the point of the reliability of the image quality, the two-component developer is more preferred.

The wax used in this invention has an endothermic initiation temperature in the DSC curve measured by a differential scanning calorimeter of 40° C. or more, preferably 50° C. or more. If the endothermic initiation temperature of the wax by the DSC curve is lower than 40° C., the toner is aggregated in a copying machine or a toner bottle. The endothermic initiation temperature depends upon the content of the low-molecular weight components in the molecular weight distribution constituting the wax, and the kind and the amount of the polar groups in the structure of the wax. In general, when the molecular weight of the wax is increased, the endothermic initiation temperature is increased together with the melting point thereof but in this case, the low-melting temperature and the low viscosity specific to the wax are spoiled. Consequently, it is effective to selectively remove these low molecular weight components only in the molecular weight distribution of the wax by a method of a molecular distillation, a solvent fractionation, a gas chromatographic fractionation, etc.

The melting point of the wax used in this invention is in the range of from 80 to 120° C. and it is desirable that the wax shows a melt viscosity at 120° C. of from 1 to 200 centipoises, and more preferably from 1 to 100 centipoises. If the melting point of the wax is lower than 80° C., the phase changing temperature of the wax is too low, whereby the blocking resistance is deteriorated and when the temperature in a copying machine is increased, the developing property becomes inferior. On the other hand, if the melting point of the wax exceeds 120° C., the phase changing temperature of the wax is too high, which is undesirable in the view point of energy saving. Also, if the melt viscosity of the wax is higher than 200 centipoises, melting out of the wax from the toner is weak and the releasing property at fixing becomes insufficient.

The wax used in this invention is obtained from the following waxes.

That is, there are a paraffin wax and the derivatives thereof, a montan wax and the derivatives thereof, a microcrystalline wax and the derivatives thereof, a Fischer-Tropsch wax and the derivatives thereof, a polyolefin wax and the derivatives thereof, etc. The derivatives of these waxes include oxides, polymers with a vinyl monomer, and graft modified products. Moreover, alcohols, fatty acids, vegetable waxes, animal waxes, mineral waxes, ester waxes, acid amides, etc., can be also utilized.

The addition amount of the wax to the toner is preferably from 1 to 10% by weight, and more preferably from 3 to 10% by weight. If the addition amount of the wax is less than 1% by weight, a sufficient fixing latitude (the temperature range of the fixing roll capable of fixing without causing offset of the toner) is not obtained. On the other hand, if the addition amount is larger than 10% by weight, the amount of the free wax released from the toner is increased and the developer-carrier is liable to be stained by the wax. Also, in this case, the powder fluidity of the toner is reduced and the free wax attaches to the surface of a photoreceptor forming an electrostatic latent image, whereby an electrostatic latent image cannot be correctly formed. Furthermore, because the wax is inferior in the transparency to a binder resin, the transparency of an image such as an OHP image, etc., is lowered to give a blackish projected image.

At present, small-sizing of the particle sizes of a toner has been demanded for obtaining a high-quality images and it is desirable that the average particle size of the toner is from 3 to 8 $\mu$m. If the average particle size of the toner is less than 3 $\mu$m, the electrostatic attaching force becomes larger than the gravity and it becomes difficult to handle the toner as a powder. Also, the amount of the toner of a small particle size side in the particle size distribution of the toner gives particularly influences on the image quality as described above. Particularly, the value of number % of the particle having a particle size of 4 $\mu$m or less in the particle size distribution is important. Consequently, in this invention, it is preferred that the amount of the particles having a particle size of 4 $\mu$m or less in the particle distribution of the toner is from 10 to 30% by number. If the amount of the particles having the particle sizes of 4 $\mu$m or less is less than 10% by number, the improvement of the image quality becomes insufficient, while if the amount becomes more than 30% by number, the developer-carrier is stained with the toner.

Also, in color toners, it is necessary that toners each having each different color are sufficiently mixed in a fixing step and to increase the color mixing property, it is preferred that the viscosity of each toner is $10^6$ poises or less at 120° C.

As the toner used in this invention, a known toner made of at least a coloring agent and a binder resin is used.

Examples of the binder resin include the homopolymers or copolymers of styrenes such as styrene, chlorostyrene, etc.; monoolefins such as ethylene, propylene, butylene, isoprene, etc.; vinyl esters such as vinyl acetate, vinyl propionate, vinyl benzoate, etc.; $\alpha$methylene aliphatic monocarboxylic acid esters such as methyl acrylate, ethyl acrylate, butyl acrylate, dodecyl acrylate, octyl acrylate, phenyl acrylate, methyl methacrylate, ethyl methacrylate, butyl methacrylate, dodecyl methacrylate, etc.; vinyl ethers such as vinyl methyl ether, vinyl ethyl ether, vinyl butyl ether, etc.; and vinyl ketones such as vinyl methyl ketone, vinyl hexyl ketone, vinyl isopropenyl ketone, etc.

Particularly typical binder resins include polystyrene, a styrene-alkyl acrylate copolymer, a styrene-alkyl methacrylate copolymer, a styrene-acrylonitrile copolymer, a styrene-butadiene copolymer, a styrene-maleic anhydride copolymer, polyethylene, and polypropylene. Furthermore, as the binder resins used in this invention, there are polyester, polyurethane, an epoxy resin, a silicone resin, polyamide, denatured rosin, paraffin, waxes, etc.

In these materials, for color toners, it is particularly preferred to use the polyester resin synthesized by the polycondensation of a polyol component and a polycarboxylic acid component, and for example, the linear polyester resin made of a polycondensation product wherein bisphenol A and a polyhydric aromatic carboxylic acid are used as the main monomer components is preferably used.

Examples of the polyol component used in this invention includes ethylene glycol, propylene glycol, 1,3-butanediol, 1,4-butanediol, 2,3-butanediol, diethylene glycol, triethylene glycol, 1,5-butanediol, 1,5-hexanediol, neopentyl glycol, cyclohexane dimethanol, hydrogenated bisphenol A, a bisphenol A-ethylene oxide addition product, and a bisphenol A-propylene oxide addition product.

Examples of the polycarboxylic acid component include maleic acid, fumaric acid, phthalic acid, isophthalic acid, terephthalic acid, succinic acid, dodecenylsuccinic acid, trimellitic acid, pyromellitic acid, cyclohexanetricarboxylic acid, 2,5,7-naphthalenetricarboxylic acid, 1,2,4-naphthalenetricarboxylic acid, 1,2,5-hexanetricarboxylic acid, 1,3-dicarboxyl-2-methylenecarboxypropanetetramethylenecarboxylic acid, and the anhydrides of them.

Also, as the binder resin, the resins having a softening point of from 90 to 150° C., a glass transition point of from 55 to 75° C., a number average molecular weight of from 2000 to 6000, a weight average molecular weight of 8000 to 150,000, and acid value of from 5 to 30, and a hydroxyl group value of from 5 to 40 are preferably used.

Also, typical examples of the coloring agents for toner particles include carbon black, Nigrosine, Aniline Blue, Chalcoyl Blue, Chrome Yellow, Ultramarine Blue, Du Pont Oil Red, Quinoline Yellow, Methylene Blue Chloride, Phthalocyanine Blue, Malachite Green oxalate, lamp black, Rose Bengal, C.I. Pigment•Red 48:1, C.I. Pigment•Red 122, C.I. Pigment•Red 57:1. C.I. Pigment•Yellow 97, C.I. Pigment•Yellow 12, C.I. Pigment•Blue 15:1, and C.I. Pigment•Blue 15:3.

The toner used in this invention, may further contain at least one of charge controlling agents for controlling the electrostatic charge of the toner as an internal additive in addition to the binder resin, the coloring agent, and the wax.

Also, the toner may further contain a petroleum resin for satisfying the grinding property and a hot shelf life. The petroleum resin is a resin synthesized using, as the raw materials, diolefins and monoolefins contained in the cracking oil fractions by-produced from an ethylene plant of producing ethylene, propylene, etc., by steam cracking of petroleums.

Furthermore, to further improve the long shelf life, the fluidity, the developing property, and the transferring property of the toner used in this invention, an inorganic powder and a resin powder may be added to the surface of the toner singly or as a combination of them. Examples of the inorganic powder include carbon black, silica, alumina, titania, and zinc oxide and examples of the resin powder include the spherical particles of PMMA, nylon, melamine, benzoguanamine, fluorine-base resin, etc., and random-shaped particles of vinylidene chloride, fatty acid metal salts, etc. In the case of adding the powder(s) to the surface of the toner, the addition amount is preferably from 0.2 to 4% by weight, and more preferably from 0.5 to 3% by weight.

In the toner used in this invention, the above-described internal additive is added to the inside of the toner particles by a kneading treatment. In this case, kneading can be carried out using various heat-kneading machines. As the kneading machine, there are a three-roll type, a single screw type, a twin screw type, and a bambury mixer type.

The production method of the toner used in this invention is optional. For example, grinding of the kneaded mixture can be carried out by a micronizer, Ulmax, a JET-O-miser, KTM (Krypton), a turbo-meejet, etc.

Furthermore, as a post step thereof, the form of the toner after grinding can be changed by applying a mechanical external force using a Hybridization system (manufactured by Nara Kikai Seisakusho K.K.), a Mechanofusion system (manufactured by Hosokawa Micron K.K.), a Kryptron system (manufactured by Kawasaki Heavy Industries, Ltd.), etc. Also, the form of the ground toner can be sphered by a hot blast.

There is no restriction on the carrier used in this invention and a known carrier can be used. For example, an iron powder-base carrier, a ferrite-base carrier, and a surface-coated ferrite-base carrier can be used.

Image formation:

The image-forming process of this invention is same as a known image-forming process except that the developer and the developer-carrier described above are used. That is, an electrostatic latent image is formed on an electrostatic latent image-carrier by an optical unit, the electrostatic latent image is developed by a developer on the developer-carrier disposed facing the latent image-carrier to form a developed image, thereafter, the developed image is transferred to a recording medium such as a recording paper, etc., and then the transferred image is fixed to the recording medium such as a recording paper, etc., by heat and pressure. Also, to remove a residual toner remaining on a photoreceptor after transferring, a cleaning step may be included.

The surface of the fixing roll is also preferably formed by a material having an excellent releasing property to the toner, such as a silicone rubber, a fluorine resin, etc., for the purpose of not attaching thereto the toner.

Hitherto, at fixing, a releasing liquid such as a silicone oil, etc., is coated on a fixing roll. The releasing liquid is effective to the fixing latitude but because the releasing liquid is transferred to a transfer material to which the toner image is fixed, the transfer material becomes sticky and also there is a problem that a tape cannot be adhered to the transfer material and letters cannot be written thereon by, for example, a magic pen, etc. This is severe when the transfer material is a material for OHP. Also, because the releasing liquid cannot make smooth the roughness of the surface of a fixing roll, it becomes a cause of lowering the transparency of an OHP image.

Because in the image-forming process of this invention, by using a toner containing a wax, a sufficient fixing latitude can be obtained, a releasing liquid such as a silicone oil, etc., which is coated on a fixing roll, is not always necessary and even when the releasing liquid is coated, the amount of the releasing liquid is preferably as small as possible for substantially avoiding the occurrence of the above-described various problems. For example, the amount thereof may be not more than 1 ml per sheet A4 paper (210 mm×297 mm).

Then, the following examples are intended to illustrate practically the present invention but not to limit the invention in any way. In addition, all parts in the examples, unless otherwise indicated, are by weight.

In addition, the properties of the waxes used in the examples of this invention and comparative examples are shown in the following Table 1.

TABLE 1

| | Kind of Wax | Melting Point (° C.) |
|---|---|---|
| Wax A | Long-chain straight-chain fatty acid saturated alcohol monoester (stearyl behenate) | 95° C. |
| Wax B | Long-chain straight-chain fatty acid intermediate-chain straight-chain saturated diol diester nonacosal montanate | 106° C. |

Preparations of toner 1 to toner 6:

Toner 1:

| | |
|---|---|
| Linear polyester | 92 parts |
| Magenta pigment (C.I. Pigment Red 57:1) | 3 parts |
| Wax A | 5 parts |

A mixture of the above-described components is kneaded by an extruder and after grinding the kneaded mixture by a grinder of a surface grinding system, fine particles and coarse particles are removed by classifying using a pneumatic classifier to obtain magenta toner particles having an average particle size $D_{50}$ of 6.7 μm. The amount of particles having a particle size of 4 μm or less in the particle size distribution of the toner is 20% by number.

In addition, as the linear polyester, a linear polyester having Tg of 62° C., Mn of 4,000, Mw of 35,000, an acid value of 12, and a hydroxyl value of 25 obtained from terephthalic acid/bisphenolA-ethylene oxide adducts/cyclohexane dimethanol is used.

Toner 2:

By following the same procedure as the case of preparing toner 1 except that wax B is used in place of wax A, toner 2 is prepared as magenta toner particles having an average particle size $D_{50}$ of 7.5 μm. The amount of particles having a particle size of 4 μm or less in the particle size distribution of the toner is 12% by number.

Toner 3:

By following the same procedure as the case of preparing toner 1 except that the classification condition is changed, toner 3 is prepared as magenta toner particles having an average particle size $D_{50}$ of 6.8 μm. The amount of particles having a particle size of 4 μm or less in the particle size distribution of the toner is 27% by number.

Toner 4:

| | |
|---|---|
| Linear polyester | 93 parts |
| Cyan Pigment (B-type phthalocyanine: C.I. Pigment·Blue 15:3) | 3 parts |
| Wax A | 4 parts |

A mixture of the above-described components is kneaded by an extruder and after grinding the kneaded mixture by a jet mill, fine particles and coarse particles are removed by classifying using a pneumatic classifier to obtain cyan toner particles having an average particle size $D_{50}$ of 7.2 μm. The amount of particles having a particle size of 4 μm or less in the particle size distribution of the toner is 15% by number.

In addition, as the linear polyester, a linear polyester having Tg of 70° C., Mn of 4,600, Mw of 38,000, an acid value of 11, and a hydroxyl value of 23 obtained from terephthalic acid/bisphenol A-ethylene oxide adducts/bisphenol A-propylene oxide adducts/cyclohexane dimethanol is used.

Toner 5:

By following the same procedure as the case of preparing toner 4 except that the classification condition is changed, toner 5 is prepared as cyan toner particles having an average particle size $D_{50}$ of 6.4 μm. The amount of particles having a particle size of 4 μm or less in the particle size distribution of the toner is 25% by number.

Toner 6:

By following the same procedure as the case of preparing toner 4 except that the Pigment Yellow 97 is used in place of the cyan pigment, toner 6 is prepared as yellow toner particles having an average particle size $D_{50}$ of 7.7 μm. The amount of particles having a particle size of 4 μm or less in the particle size distribution of the toner is 22% by number.

Preparation of developers:

To 100 parts of each of toner 1 to toner 6 obtained are added 1.0 part of a negative-charging silica and 0.5 part of negative-charging titania to provide each externally added toner. To 100 parts of a carrier prepared by coating ferrite particles having an average particle size of 50 μm with a styrene-methyl methacrylate copolymer is added 6 parts of each of the externally added toners followed by mixing to obtain corresponding developers 1 to 6.

Preparation of developer-carriers 1 to 5:

Developer-carrier sleeve 1:

The surface of the developing sleeve (material; SUS, diameter; 30 mm) used in the developing apparatus of a commercially available electrophotographic copying machine (A-Color 635, trade name, manufactured by FUJI XEROX CO., Ltd.) is subjected to blast working with spherical glass beads using Pneumablaster (trade name, manufactured by Fuji Seisakusho K.K.) to prepare developing sleeve 1. Rz=3.6 μm, Sm=129 μm, and Rz×20=72<Sm=129.

Developer-varrier sleeve 2:

By following the same procedure as the case of preparing developing sleeve 1, developing sleeve 2 having Rz=5.3 μm, Sm=115 μm, and Rz×20=106<Sm=115 is prepared.

Developer-carrier sleeve 3:

The surface of the developing sleeve (material; SUS, diameter; 30 mm) used in the developing apparatus of a commercially available electrophotographic copying machine (A-Color 635, trade name, manufactured by FUJI XEROX CO., Ltd.) is subjected to blast working with random-shaped alumina particles using Pneumablaster (trade name, manufactured by Fuji Seisakusho K.K.) to prepare developing sleeve 3. Rz=5.0 μm, Sm=70 μm, and Rz×20 =100<Sm=70.

Developer-carrier sleeve 4:

By following the same procedure as the case of preparing developing sleeve 3, developing sleeve 4 having RZ=6.5 μm, Sm=105 μm, and Rz×20=130<Sm=105 is prepared.

Developer-carrier sleeve 5:

By following the same procedure as the case of preparing developing sleeve 3, developing sleeve 5 having Rz=6.5 μm, Sm=90 μm, and Rz×20=130<Sm=90 is prepared.

EXAMPLES 1 TO 6 AND COMPARATIVE EXAMPLES 1 TO 3

As shown in Table 2 below, using the combination of each of the developers and each of the developer-carrier sleeves described above, by the electrophotographic copying machine (A-Color 635, trade name, manufactured by FUJI XEROX CO., Ltd.), the copying test of 20,000 papers is carried out and then the offset property, the extent of staining each developer-carrier sleeve with the toner after copying test, and the image qualities of the copied images are evaluated by the following methods. The evaluation results are shown in Table 2.

Offset property:

Using the electrophotographic copying machine (A-Color 635, trade name, manufactured by FUJI XEROX CO., Ltd.), a solid unfixed toner image having a length of 5 cm and a width of 4 cm is formed on a transfer paper of A4. In this case, the toner image is formed such that the amount of the toner became from 0.6 to 0.8 mg/cm$^2$. Then, using above-described A-Color 635 modified such that the fixing temperature could be desirably established and could be monitored, and after stopping the supply of a releasing oil to the fixing roll, a copying test is carried out in the state that a releasing oil does not substantially exist on the surface of the fixing roll. That is, the surface temperature of the fixing roll is stepwise changed and using each transfer paper carrying the above-described toner image, fixing of the unfixed toner image is carried out at each surface temperature. In this case, whether or not the blank portion of each paper having the fixed toner image had a toner stain from the fixing roll is observed and the temperature region of causing no stain is defined to be a non-offset temperature region.

Toner staining on developer-carrier sleeve:

Staining of each sleeve with the toner is evaluated as follows. That is, each sleeve is blown off by compressed air after the copying test, the density of the sleeve surface is measured by an X-Rite spectrometric densitometer manufactured by X-Rite Company, and the stain is evaluated by the density difference Δ from the surface density of an unused sleeve. In this case, however, the density of the sleeve surface is measured by matching with the color of the evaluated toner.

Image quality of copied image:

The image quality of the copied image is evaluated by visually observing the solid image after fixing and by the existence or absence of density spots.

TABLE 2

| | Sleeve No. | Toner No. | Relation between Rz and Sm | Amount of particles of particle sizes ≦ 4 μm | Stain of sleeve with toner after test | Non-offset temperature region |
|---|---|---|---|---|---|---|
| Example 1 | 1 | 1 | Rz × 20 = 72 < Sm = 129 | 20 | Δ0.05 | 120–190 |
| Example 2 | 1 | 2 | Rz × 20 = 72 < Sm = 129 | 12 | Δ0.04 | 120–180 |
| Example 3 | 2 | 3 | Rz × 20 = 106 < Sm = 115 | 27 | Δ0.08 | 120–190 |
| Example 4 | 2 | 4 | Rz × 20 = 106 < Sm = 115 | 15 | Δ0.05 | 120–190 |
| Example 5 | 1 | 5 | Rz × 20 = 72 < Sm = 129 | 25 | Δ0.07 | 120–190 |
| Example 6 | 1 | 6 | Rz × 20 = 72 < Sm = 129 | 22 | Δ0.04 | 120–180 |
| Comparative Example 1 | 3 | 1 | Rz × 20 = 100 > Sm = 70 | 20 | Δ0.25 | 120–190 |
| Comparative Example 2 | 4 | 2 | Rz × 20 = 130 > Sm = 105 | 12 | Δ0.27 | 120–180 |
| Comparative Example 3 | 5 | 1 | Rz × 20 = 130 > Sm = 90 | 20 | Δ0.30 | 120–190 |

As is clear from the results of Table 2, in the cases of the combinations of the toners and the sleeves in Examples 1 to 6 of this invention, staining of the surface of each sleeve with each of the toners is less and where are no troubles on the copied images.

On the other hand, in the cases of the combinations of those in Comparative Examples 1 to 3, stains occurred, unevenness occurred on the developer layer on each sleeve, and the density unevenness is observed on each solid image of the copy.

Also, the fixing property of the toners in the examples of this invention is good and the non-offset temperature region is from a low temperature to a high temperature, which showes a broad fixing latitude.

EXAMPLE 7

The developing apparatus in Example 1, Example 4, and Example 6 are mounted on the electrophotographic copying machine A-Color 635 and a full-color image is formed. As the result thereof, the red color and the blue color does not have unnatural light and shade and a clear image is obtained.

COMPARATIVE EXAMPLE 4

The developing apparatus in Comparative Example 1, Example 4, and Example 6 are mounted on the electrophotographic copying machine A-Color 635 and a full-color image is formed. As the result thereof, the image of the red-color and blue-color portions is largely disturbed. That is, the red-color portion is mixed with an orange-colored portion and the blue-color portion is mixed with a blackish portion and a light-blue portion.

As described above, according to this invention, an image-forming process wherein the conveying property of a developer is good, staining of the surface of the developer-carrier can be prevented, images having a high image quality and excellent fixing property are obtained for a long period of time, even in the case of using oil-less color toner(s) containing a wax.

What is claimed is:

1. An image-forming process comprising a step of forming an electrostatic latent image on an electrostatic latent image-carrier and a step of developing the electrostatic latent image by a developer on a developer-carrier disposed opposite to the electrostatic latent image-carrier, wherein said developer contains a color toner containing a wax which amount is from 1 to 10% by weight of the toner, and ten-point average roughness (Rz) of the surface of said developer-carrier and average spacing (Sm) of roughness peaks of the surface of said developer-carrier meet the following formula;

$$5 \leqq Rz \times 20 \leqq Sm.$$

2. The image-forming process according to claim 1 wherein the Rz of the surface said developer-carrier is in the range of the following formula;

$$0.5 \leqq Rz \leqq 10.$$

3. The image-forming process according to claim 1 wherein said developer is a two-component developer comprising a carrier and the toner.

4. The image-forming process according to claim 1 wherein in said toner, an amount of particles having a particle size of 4 $\mu$m or less in a particle size distribution thereof is from 10 to 30% by number.

5. The image-forming process according to claim 1 wherein viscosity of said toner is $10^6$ poises or less at 120° C.

6. The image-forming process according to claim 1 wherein melting point of said wax is from 80 to 120° C. and the Rz is in the range of $0.5 \leqq Rz \leqq 10$.

7. The image-forming process according to claim 6 wherein the Rz is in the range of $1 \leqq Rz \leqq 8$.

8. The image-forming process according to claim 1 wherein $Sm/Rz \leqq 100$.

9. The image-forming process according to claim 1 wherein said Sm is 80 or more but 200 or less.

10. The image-forming process according to claim 9 wherein said Sm is 100 or more but 200 or less.

11. The image-forming process according to claim 1 wherein a diameter of the developer-carrier is from 10 mm to 35 mm.

12. The image-forming process according to claim 10 wherein the diameter of the developer-carrier is from 15 mm to 27 mm.

13. The image-forming process according to claim 1 wherein endothermic initiation temperature of the wax in the DSC curve measured by a differential scanning calorimeter is 40° C. or more.

14. The image-forming process according to claim 1 wherein the melt viscosity of the wax is from 1 to 200 centipoises at 120° C.

15. The image-forming process according to claim 1 wherein the addition amount of the wax is from 3 to 10% by weight of the toner.

16. The image-forming process according to claim 1 wherein a binder resin for said toner having a softening point of from 90 to 150° C., a glass transition point of from 55 to 75° C., a number average molecular weight of from 2000 to 6000, a weight average molecular weight of from 8000 to 150,000, an acid value of from 5 to 30, and a hydroxyl group value of from 5 to 40.

17. The image-forming process according to claim 1 wherein said toner has an external additive and an addition amount of the external additive is from 0.2 to 4% by weight of the toner.

* * * * *